US005085125A

United States Patent [19]

Emo et al.

[11] Patent Number: 5,085,125

[45] Date of Patent: Feb. 4, 1992

[54] OPTICALLY CONTROLLED TRANSDUCER

[75] Inventors: Stephen M. Emo, Elkhart; Terrance R. Kinney, South Bend, both of Ind.

[73] Assignee: Allied-Signal Inc., Morristown, N.J.

[21] Appl. No.: 632,210

[22] Filed: Dec. 21, 1990

[51] Int. Cl.[5] ..... F15B 13/044

[52] U.S. Cl. ..... 91/459; 137/625.65; 251/129.06

[58] Field of Search ..... 91/459; 137/625.65; 251/129.06

[56] References Cited

U.S. PATENT DOCUMENTS 4,538,633 9/1985 Stevens ..... 137/625.64 X 4,825,894 5/1989 Cummins ..... 251/129.06 X

*Primary Examiner*—Gerald A. Michalsky

*Attorney, Agent, or Firm*—Leo H. McCormick, Jr.; Larry J. Palguta; Robert A. Walsh

[57] ABSTRACT

An optically controlled fluid powered actuator is disclosed and includes a primary fluid valve positioning transducer which responds to optical binary coded control words to position a fluid. The actuator has a pair of opposed stacks of piezoelectric elements with the relative length of the piezoelectric elements in each stack being in the same ratios as the relative weights of bits in the control words. There are two sets of optically actuated electrical switches each responsive to control words to energize corresponding ones of the piezoelectric elements in an associated stack of elements. A first class lever has one end coupled to a controlling portion of a fluid valve and the other end interposed between the stacks of piezoelectric elements so that the lever can translate motion of elements in a piezoelectric stack into fluid valve actuation. A fluid powered electrical generator provides the sole source of electrical energy for the piezoelectric elements. A pair of optical fibers convey the optical binary coded control words in the form of a wavelength division multiplexed optical signal to corresponding ones of the sets of switches.

3 Claims, 1 Drawing Sheet

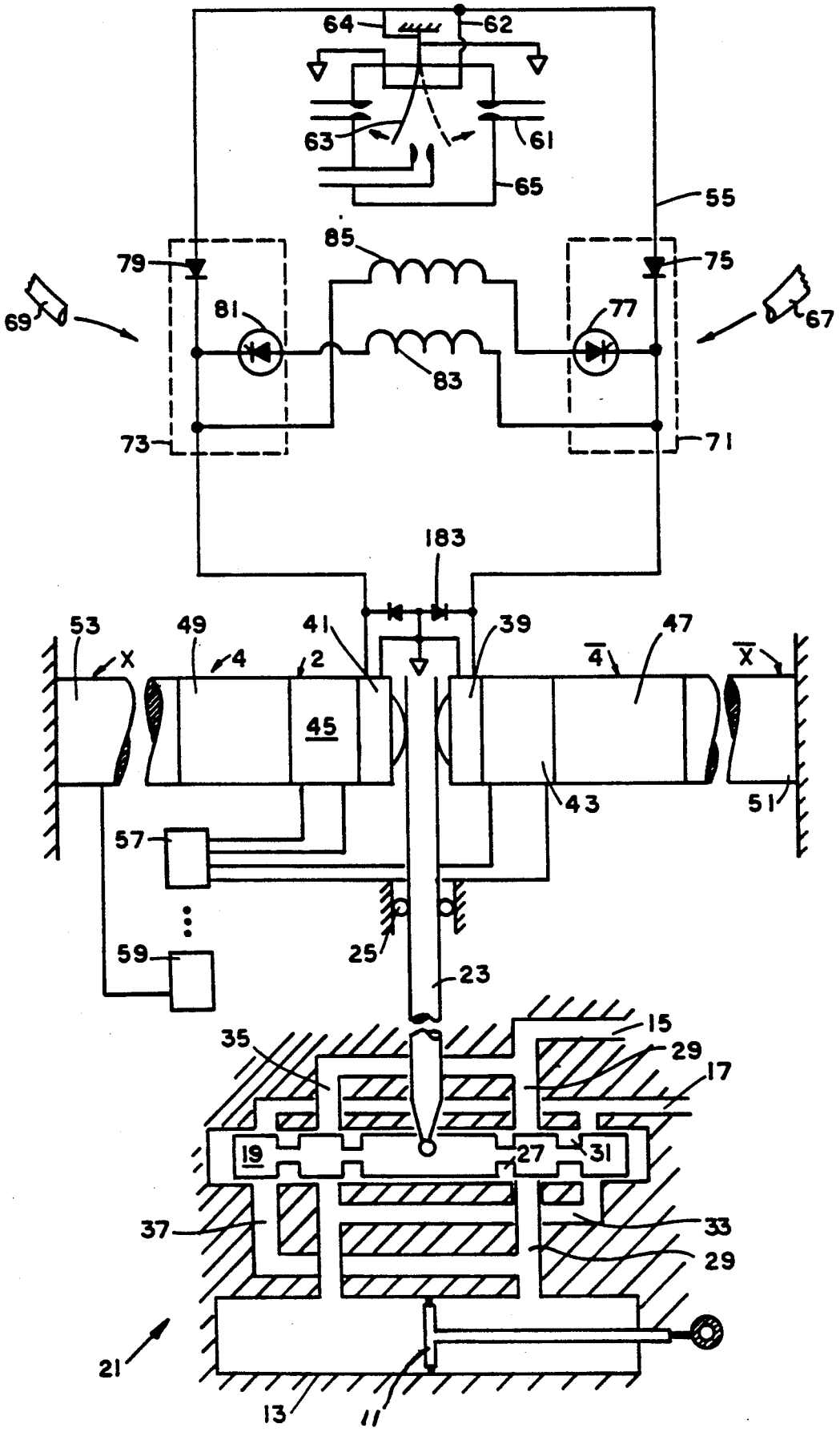
64
62
63
61
65
55
85
79
75
69
81
77
67
83
73
71
183
53
49
41
39
47
X
4
2
4
X
45
43
51
57
59
25
23
15
35
29
17
19
27
31
37
33
29
21
13
11

OPTICALLY CONTROLLED TRANSDUCER

The present invention relates generally to an optically controlled, fluid powered transducer and more particularly to such a transducer for controlling a fluid controlling valve. In a preferred embodiment, the transducer is pneumatically powered and responds to a digitally coded optical signal to control a primary hydraulic valve.

Electrical wiring has been the common vehicle for conveying control signals from point to point in virtually every imaginable environment. Signals on such wires are subject to degradation by incident electromagnetic radiation. Such electromagnetic interference may also be introduced by way of the conductors which supply power to a particular unit. Electrical shielding of the wires may help to alleviate the problem in some environments, but adds a weight penalty. The use of fiber optics for conveying control signals is also a solution to this problem. Also, in many applications, it is simply impractical to convey electrical power from a remote source to drive a particular unit.

Among the several objects of the present invention may be noted the provision of an actuator which has no need for an external electrical source; the provision of a valve controlling system requiring no external electrical supply; the provision of an optically controlled fluid powered actuator; the provision of a control system which is relatively immune to electromagnetic interference; the provision of a fluid actuator having no electrical inputs; and the provision of a primary hydraulic valve positioning transducer. These as well as other objects and advantageous features of the present invention will be in part apparent and in part pointed out hereinafter.

In general, an optically controlled fluid powered actuator has a fluid powered electrical generator as its sole source of electrical energy, a pair of opposed stacks of piezoelectric elements for converting electrical energy into mechanical motion, and two sets of optically actuated electrical switches, each set of switches being responsive to wavelength division coded optical signals to energize (charge and discharge) corresponding ones of the piezoelectric elements in its associated stack of elements to provide mechanical motion. The piezoelectric elements are formed as a pair of opposed stacks of elements and the electrical switches includes circuitry interconnecting individual pairs of piezoelectric elements, one from each stack, so that the electrical switches may respond to an optical signal to transfer an electrical charge from a previously energized piezoelectric element to the corresponding piezoelectric element in the other stack. A pair of optical fibers are provided for conveying wavelength division multiplexed optical signals to the sets of switches. A pressurized fluid source such as high pressure air, for example, from a bypass compressor, is provided for driving the electrical (charging) generator. A source of pressurized fluid such as hydraulic fluid, a movable spool type fluid control valve, and a fluid powered piston are connected in circuit with one another so that spool motion controls piston movement. A lever couples the piezoelectric elements and the fluid control valve. Optical control signals which are incident the optically actuated switch cause motion of the piezoelectric elements thereby moving the lever and the control valve to control the piston. The relative lengths of the piezoelectric elements in each stack may form a geometric sequence and the optical signals can then be in a pure binary code so that the magnitude of the mechanical motion of the piezoelectric means is directly proportional to the magnitude of a received coded optical signal.

BRIEF DESCRIPTION OF THE DRAWING

The drawing FIGURE is a schematic representation of an optically controlled, fluid powered transducer illustrating the present invention in one form.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring now to the drawing in greater detail, actuator motion is illustrated by movement of the piston 11 within cylinder 13. Piston 71 may be connected to any of a wide variety of devices to be actuated thereby. Piston 11 is powered by a high pressure hydraulic source at inlet 15 and the hydraulic fluid from this source may be returned at low pressure outlet 17. High pressure fluid is supplied to one or the other faces of the piston 11 according to the position of the spool 19 in control valve 21. Spool 19 is depicted in the neutral position when no fluid is supplied to either face of the piston 11. When lever 23 pivots counterclockwise about fulcrum 25, the spool 19 moves to the right aligning notch or annular groove 27 with conduit 29 supplying high pressure fluid to the right hand face of the piston driving it toward the left as viewed. At the same time, notch 31 aligns with and opens conduit 33 to vent displaced fluid from the left hand side of the piston. Clockwise pivoting of the lever 23 similarly opened conduit 35 to supply high pressure fluid to drive the piston back toward the right and displaced fluid being vented by way of conduit 37 to the low pressure outlet 17. The speed of piston movement is governed, among other things, by the degree to which a notch (recessed portion of spool 19) such as 27 opens its corresponding conduit and this is in turn governed by the amount of pivotal motion experienced by the lever 23. Lever 23 is a first class lever with one end engaging the spool 19 and its opposite end interposed between the stacks of piezoelectric elements 39, 43, 47 and 51 on the right, and 41, 45, 49 and 53 on the left. These piezoelectric elements are poled in a direction to expand and contract axially in a horizontal direction as viewed when a voltage is applied.

Each pair of piezoelectric elements has an associated control unit such as 55, 57 or 59 which are substantially identical and only 55 is shown in detail. Make up electrical energy is supplied by a generator in the form of unstable pneumatic amplifier or multivibrator 65. High pressure air or other fluid is supplied to pipes such as 61 and that air causes a reed 63 to vibrate back and forth much the same as a reed in a clarinet or similar musical instrument. A conventional pneumatic amplifier 65 without the normal stability feature may be used. Reed 63 is also piezoelectric and develops an alternating current voltage when flexed. This voltage is supplied by way of lines 62 and 64 to all the control units 55, 57, and 59 constituting a common make-up voltage source, or there may be an unstable pneumatic amplifier for each such control unit. Thus, piezoelectric element 63 operates in a flexural mode while the stacked elements 39-53 operate in an expansion and contraction mode as controlled by the charge directing controls 55, 57 and 59.

A pair of optical fibers are directed toward the light sensitive semiconductor devices or optically actuated switches 71 and 73 respectively. When light from an optical fiber, for example 67, is incident the semiconductor, the device behaves electrically like a diode 75 and a semiconductor-controlled rectifier (SCR) both of which have been rendered conductive so long as they are illuminated and forward biased. Thus, with light carried by optical fiber 67 illuminating the device 71, the voltage generated by reed 63 passes through diode 75 to piezoelectric element 39. Further, the charge in element 41 is passed through coil 85 to element 39, while the generated charge provides the make-up energy lost in the transfer. A charge is thereby maintained on element 39 causing it to be extended forcing the lever 23 to pivot counterclockwise and piston 11 to be retracted into cylinder 13. A light signal on fiber 67 may be thought of as an "off" signal. The signals on fibers 67 and 69 may occur in the alternative, that is one is the logical complement of the other. So long as light carried by optical fiber 67 is illuminating the semiconductor 71, no light is communicated through optical fiber 69. When it is desired to turn the actuator to the "on" condition, 67 is extinguished and 69 is illuminated turning both diode 79 and SCR 81 to their conducting states. The charge which had been maintained on element 39 is now rapidly transferred to element 41 causing the element to extend or expand. Inductors such as coils 83 and 85 are interposed to prevent this charge transfer from occurring too rapidly. Resistors could, of course, be used instead, but are not preferred because of the greater losses associated with such resistors. Any voltage generated by compression of element 39 is shorted by diode 183 and the charge on element 41 is now maintained by the rectified output from reed 63.

There are control units such as 57 and 59 substantially the same as unit 55 for each pair of opposed piezoelectric elements, however, integration of the several control units into a signal unit is possible. For example, control unit 57 controls the elements 43 and 45. Multibit optical control words may be sent to the several control units by providing a pair of fibers or wavelength division multiplexed demultiplexing unit for each control unit and, therefor, for each pair of opposed elements, or by employing a single pair of optical fibers each for conveying a wavelength division multiplexed optical signal to a corresponding one of the sets of switches such as 71 and 73. A single fiber with each individual signal as well as its complement interleaved in the wavelength division multiplexed signal is also possible.

For convenience, the lengths of the several piezoelectric elements in each stack form a geometric sequence having a common ratio of two. Thus, the relative lengths (horizontal extent as shown) of the piezoelectric elements in each stack are in the same ratios as the relative weights of bits in a pure or straight binary control word. Of course, a different common ratio may be used, and the sequence need not be geometric. Depending on the system needs, nonlinear or even near exponential sequences may be used. In general, if there are k piezoelectric elements in each stack and each optical binary coded control word is k bits in length, there will be two sets of k optically actuated electrical switches with each set of switches being responsive to a k-bit control word to energize corresponding ones of the piezoelectric elements in one of the two stacks. Under these conditions, it is possible to position the fluid valve 21 in any of $2^k$ positions.

As an example, control unit 55 corresponds to the low order bit position in a control word. If that bit position is a "one" then fiber 69 will be illuminated while fiber 67 will be dark and element 39 will be extended. If that low order bit position is a "zero", then fiber 67 is illuminated and fiber 69 is dark and element 41 will be actuated to extend. The next higher order bit will be supplied to control unit 57 associated with elements 43 and 45 which are twice the length of elements 39 and 41. Energization of element 43, for example, with result in a linear motion twice as far as when element 39 is energized. Thus, the change in length of a stack of piezoelectric elements is expressed by the magnitude of the corresponding binary control word.

From the foregoing, it is now apparent that a novel optically controlled transducer requiring no external electrical source has been disclosed meeting the objects and advantageous features set out hereinbefore as well as others. The techniques disclosed have wide applicability to control functions other than the disclosed positioning of a hydraulic control valve. Numerous modifications as to the precise shapes, configurations and details may be made by those having ordinary skill in the art without departing from the spirit of the invention or the scope thereof as set out by the claims which follow.

We claim:

1. An optically controlled fluid powered actuator having a fluid powered electrical generator driven by pressurized air to develop its sole source of electrical energy, said electrical generator being connected to first piezoelectric means through switch means, a pair of optical fibers each for conveying a wavelength division multiplexed optical signal to said switch means, said first piezoelectric means having a pair of opposed stacks of piezoelectric elements for converting said electrical energy into mechanical motion, said opposed stacks each having a relative length formed by a geometric sequence of piezoelectric elements, said switch means having two sets of electrical switches, each set of switches being responsive to said wavelength division multiplexed optical signals to allow electrical energy from said electrical generator to be selectively communicated to corresponding ones of the piezoelectric elements in an associated stack of piezoelectric elements, said piezoelectric elements responding to said electrical energy by expanding and contracting to develop said mechanical motion, said optical signals being in a pure binary code whereby the magnitude of said mechanical motion of the piezoelectric element is directly proportional to the magnitude of the wavelength division multiplexed optical signal, a movable spool type fluid control valve connected to a fluid powered piston, a lever coupling the opposed stacks of piezoelectric elements with the fluid control valve whereby movement of said lever is dependent on said mechanical motion of said piezoelectric elements to corresponding move the lever and position the control valve to allow pressurized fluid to operate the piston.

2. The optically controlled fluid powered actuator of claim 1 further including: circuitry interconnecting individual pairs of piezoelectric elements, one from each stack, the electrical switch means being responsive to an optical signal for transferring an electrical charge from a previously energized piezoelectric element to the corresponding piezoelectric element in the other stack.

3. The optically controlled fluid powered actuator of claim 2 wherein said fluid powered electrical generator includes:

second piezoelectric means having a reed which responds to said pressurized air by vibrating to develop said electrical energy.

* * * * *